US009618262B2

(12) United States Patent
Peterson

(10) Patent No.: US 9,618,262 B2
(45) Date of Patent: Apr. 11, 2017

(54) COLUMN DELUGE SUPPRESSION SYSTEM

(71) Applicant: Custom Dryer Suppression System, LLC, Napoleon, OH (US)

(72) Inventor: Wesley L. Peterson, Indianapolis, IN (US)

(73) Assignee: Custom Dryer Suppression System, LLC, Napoleon, OH (US)

( * ) Notice: Subject to any disclaimer, the term of this patent is extended or adjusted under 35 U.S.C. 154(b) by 431 days.

(21) Appl. No.: 14/181,266

(22) Filed: Feb. 14, 2014

(65) Prior Publication Data

US 2014/0223760 A1 Aug. 14, 2014

Related U.S. Application Data

(60) Provisional application No. 61/764,656, filed on Feb. 14, 2013.

(51) Int. Cl.
*F26B 17/12* (2006.01)
*F26B 17/16* (2006.01)

(52) U.S. Cl.
CPC ..... *F26B 17/16* (2013.01); *F26B 2200/06* (2013.01)

(58) Field of Classification Search
CPC ..... F24C 15/2057; F24C 15/20; A62C 3/065; A62C 3/0221; A62C 3/0214; A62C 2/08; A62C 3/004; A62C 3/002
See application file for complete search history.

(56) References Cited

U.S. PATENT DOCUMENTS 1,346,099 A * 7/1920 Byrd ..... A62C 3/06 169/68
4,149,844 A * 4/1979 Noyes ..... F26B 17/122 34/174
6,209,654 B1 * 4/2001 Curless ..... A62C 31/02 137/74
2005/0236166 A1 * 10/2005 Bentzien ..... B05B 15/065 169/37
2010/0266396 A1 * 10/2010 Thut ..... F04D 29/628 415/200
2011/0226497 A1 * 9/2011 Yamodo ..... A62C 2/08 169/45

FOREIGN PATENT DOCUMENTS

CN 2489810 Y 5/2002
DE 102009018501 A1 * 10/2010 ..... A62C 3/002

OTHER PUBLICATIONS

Preventing and Responding to Grain-Dryer Fires, Chuck Kunisch, 2012 (4 pages).
Internal Riser Pipe, Michigan Ag Commodities (10 pages).

* cited by examiner

*Primary Examiner* — Jason Lau
(74) *Attorney, Agent, or Firm* — MacMillan, Sobanski & Todd, LLC

(57) ABSTRACT

A column deluge suppression system for suppressing a hazard occurring in a grain dryer includes a plurality of vertical column sections and a segmented, annular manifold. The manifold is positioned around the upper section of the grain dryer in proximity to the grain columns. The manifold includes a plurality of elongated deluge drops that extend toward the grain column openings and permit water to drench the grain columns.

4 Claims, 17 Drawing Sheets

COLUMN DELUGE SUPPRESSION SYSTEM

CROSS-REFERENCE TO RELATED APPLICATIONS

This application claims the benefit of U.S. Provisional Application No. 61/764,656, filed Feb. 14, 2013, the disclosure of which is incorporated herein by reference.

TECHNICAL FIELD

The invention relates generally to grain dryers. More specifically, the invention is directed to a column deluge suppression system for suppressing a fire in a grain dryer.

BACKGROUND OF THE INVENTION

Hazards that may occur in a grain dryer, such as a dust explosion, fire, or other such event, are difficult to suppress because the grain and the attendant hazard are contained within the dryer. Some of these hazards may be fought by spraying water on the exterior of the grain dryer. This, however, does little to suppress the hazard at its source, i.e., within the dryer. In addition, current emergency response protocols involve evacuating burning grain from the dryer by way of the lower discharge chutes. This attempt to bring the fuel source to the responders, in turn, tends to loosen the grain particulate which increases surface area and oxygen content. Thus, these hazards can frequently escalate in severity, ultimately resulting in the destruction of the dryer. It can also expose operators and firefighters to unpredictable safety hazards. The invention provides an efficient and economical column deluge suppression system for suppressing a hazardous event in a grain dryer.

BRIEF SUMMARY OF THE INVENTION

This invention relates generally to grain dryer systems. In particular, the invention relates to a column deluge suppression system for suppressing hazards that may occur in a grain dryer.

DETAILED DESCRIPTION OF THE INVENTION

Figure 1:
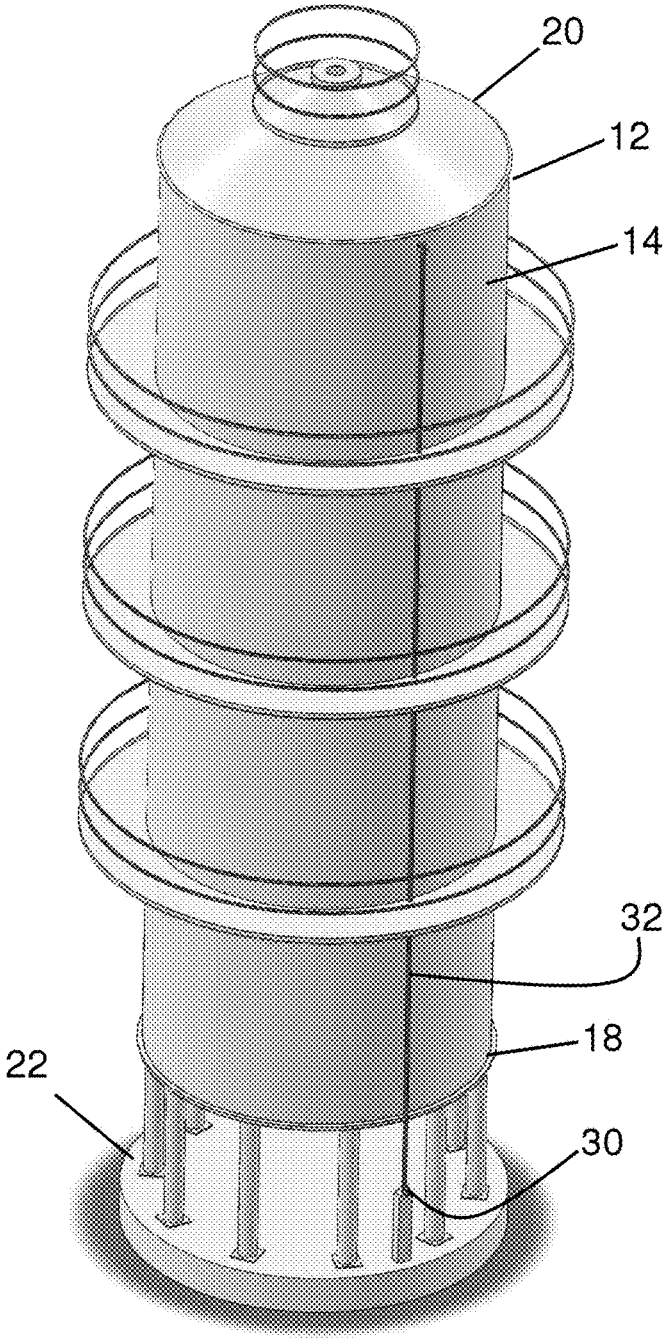
FIG. 1 is a perspective view of a grain dryer in which the column deluge suppression system is positioned according to various embodiments of the invention.

The invention will now be described in detail with reference being made to the drawings. The column deluge suppression system according to the invention is indicated generally in the drawing by the reference number "10." Referring to FIGS. 1-3, the column deluge suppression system 10 is utilized with a grain dryer 12 having an exterior 14, an interior 16, a bottom 18 and a top 20. The grain dryer 12 is positioned on a foundation 22 at the bottom 18. The interior 16 includes a grain column 24, which may be a singular annular cavity or a plurality of column sections dispersed around the perimeter of the drying tower for containing grain during drying. The inner and outer walls that define the column 24 are typically perforated to permit air, and in particular heated air, to pass through and dry the grain contained therein. A heating section is defined within the interior 16, such as a heat plenum chamber 26, adjacent to the columns 24. The chamber 26 has a heating device such as a burner (not shown), which may be conventional in the art.

FIGS. 1-13 show a first embodiment column deluge suppression system 10 according to the invention. In this embodiment, the system 10 includes an inlet 30 positioned on or near the foundation 22. One or more vertical supply sections 32 that are in fluid communication with the inlet 30 extend from the bottom 18 to the top 20 of the dryer 12 along the exterior 14. The inlet 30 is adapted to connect to any variety of water sources. In one embodiment, the inlet 30 is configured to accept a Fire Department Connection (FDC) type connector such as, for example, a two simultaneous hose, or siamese, connection.

Figure 2:
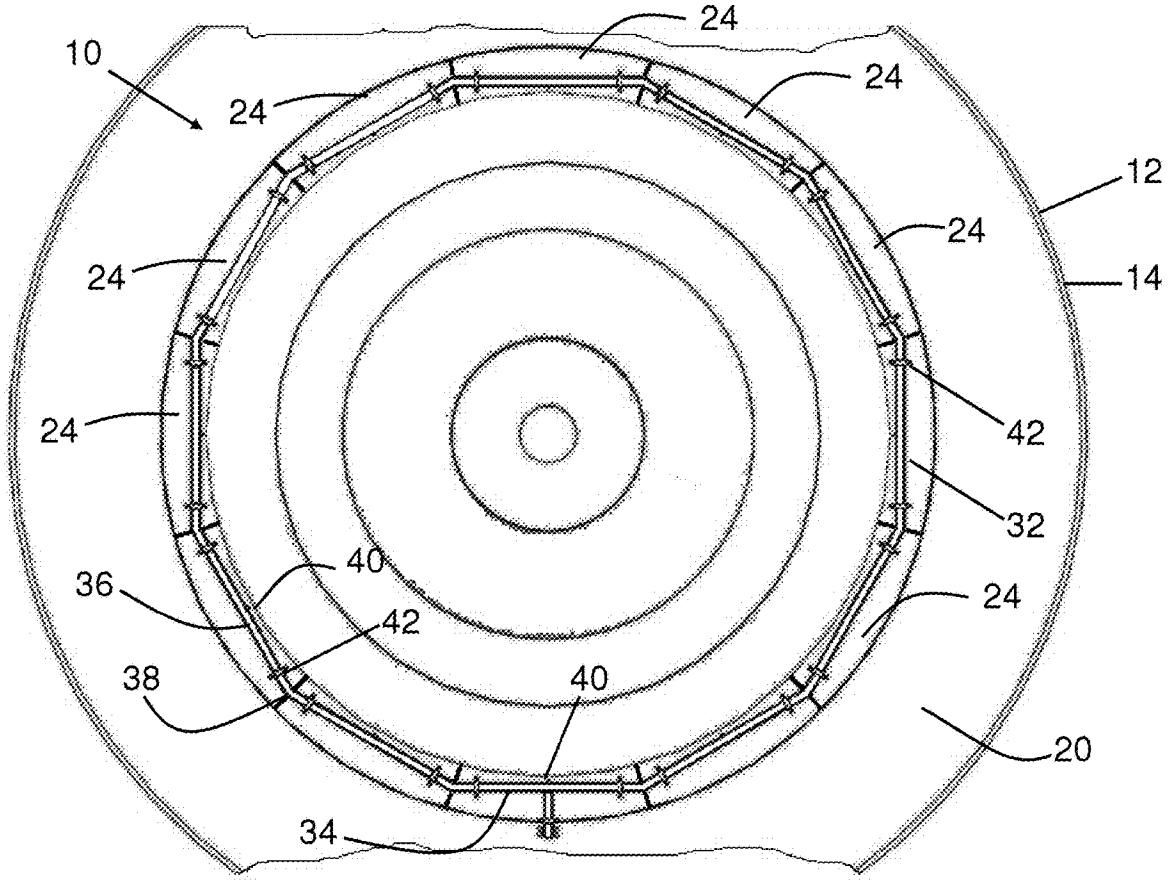
FIG. 2 is a is a top plan view of a first embodiment column deluge suppression system in a grain dryer.
Figure 3:
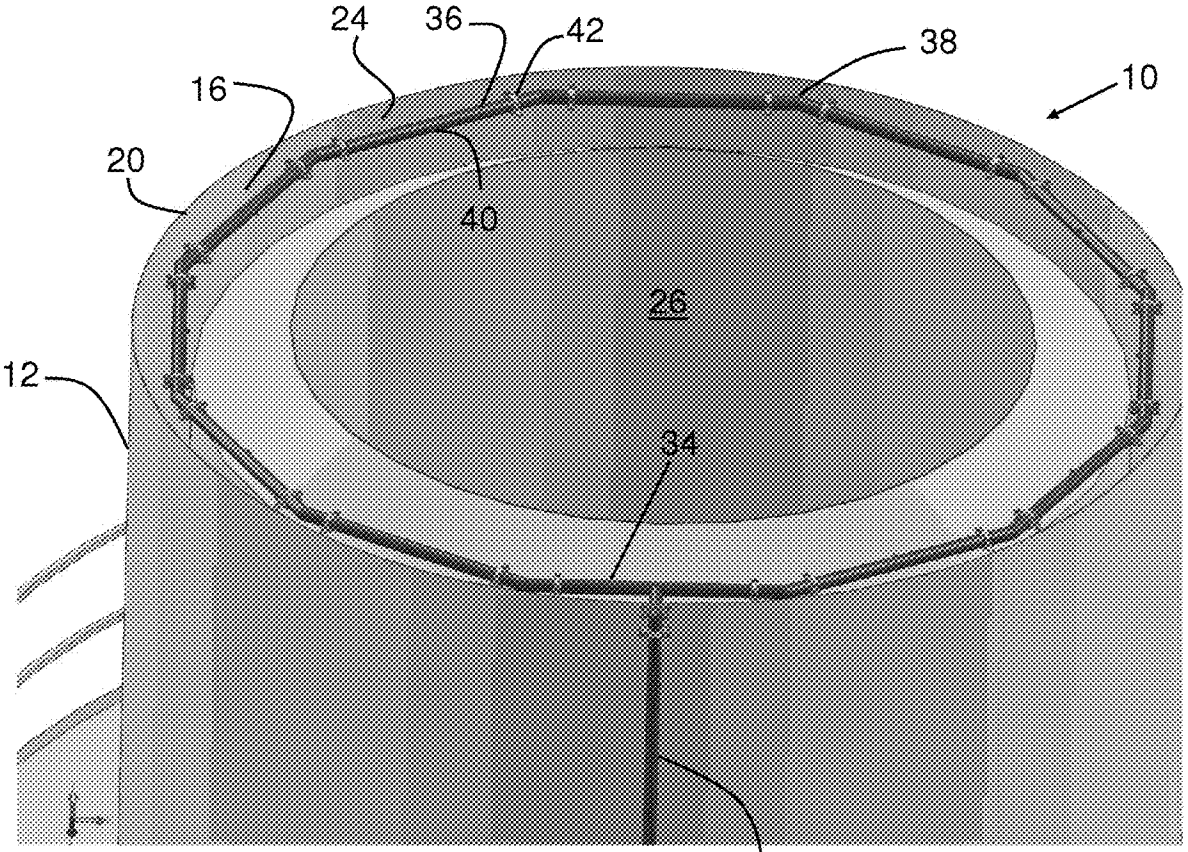
FIG. 3 is a is a perspective view of the first embodiment column deluge suppression system.
Figure 4:
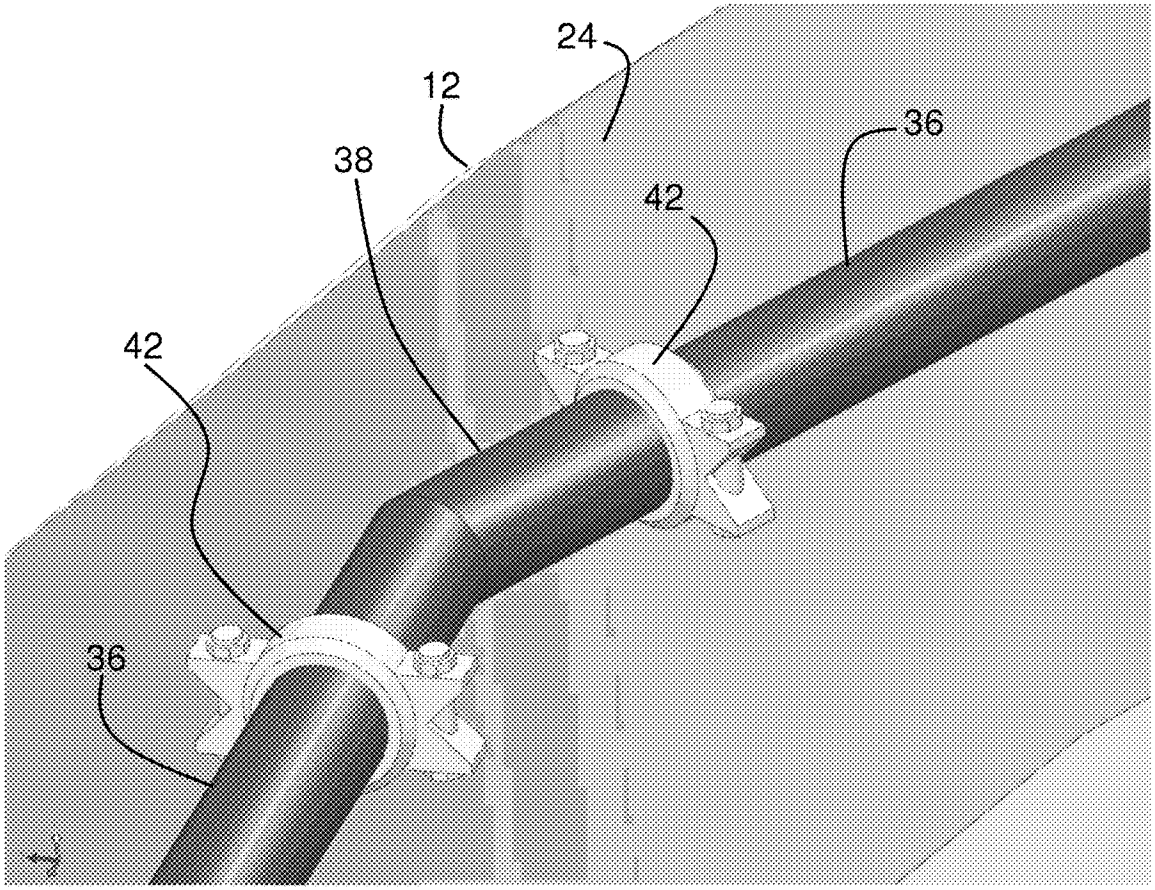
FIG. 4 is a is a detailed view of two horizontal column sections, a bend and two groove couplers.
Figure 5:
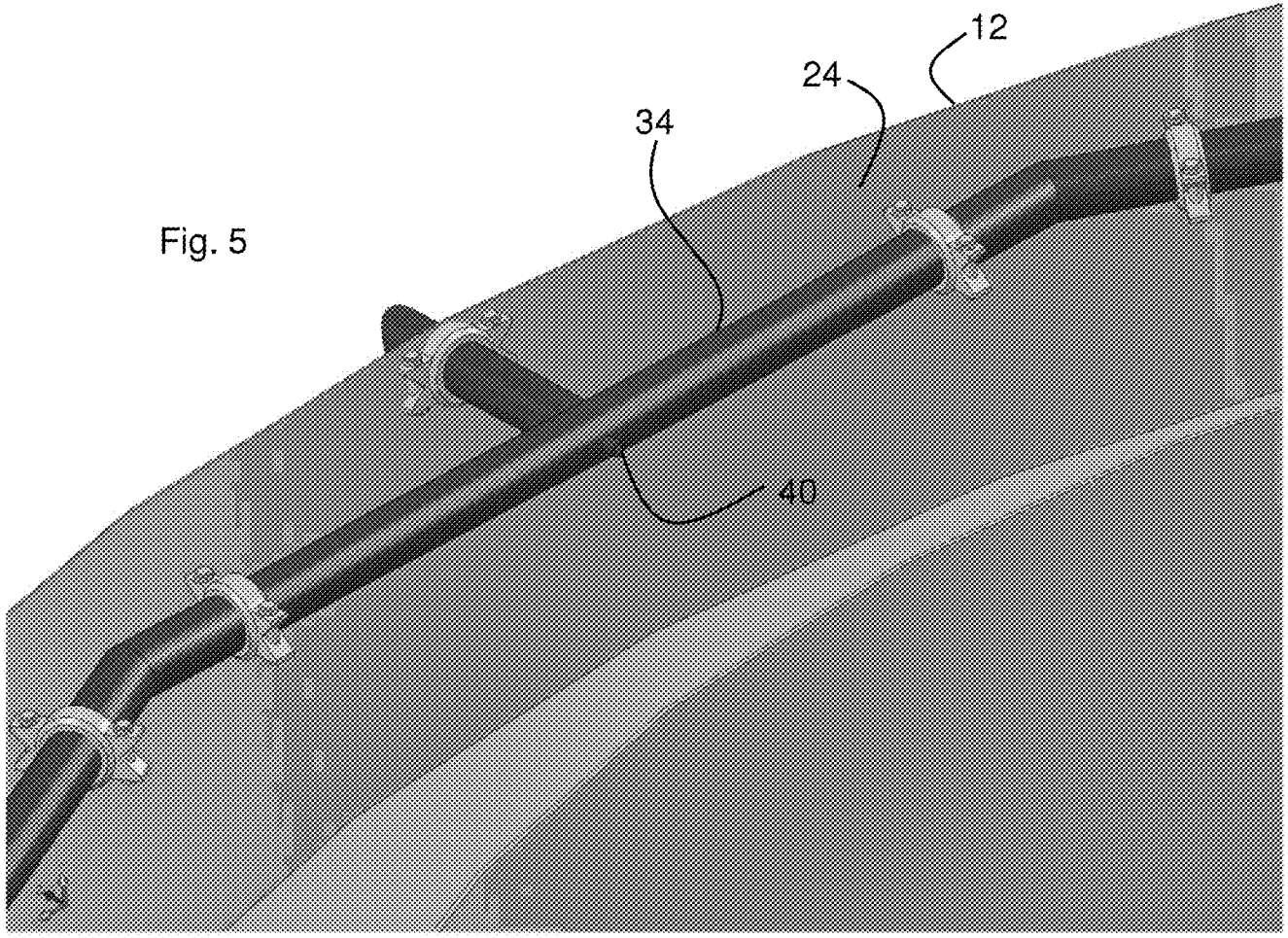
FIG. 5 is a detailed view of a starter section with outlet, two horizontal column sections, two bends and five groove couplers.
Figure 6:
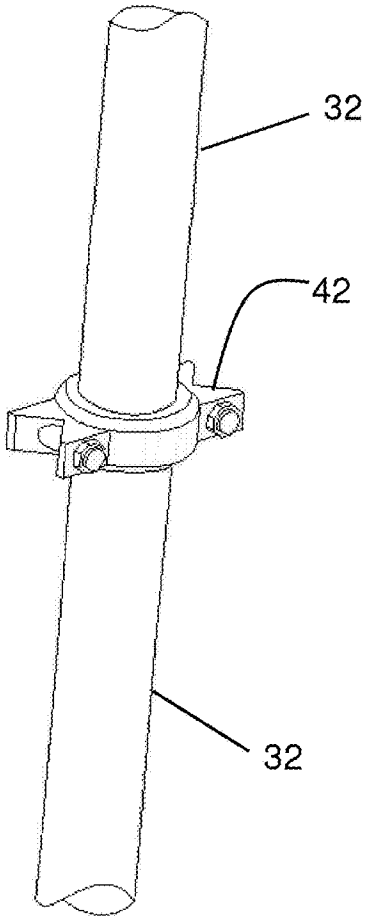
FIG. 6 is a is a detailed view of two vertical column sections and a groove coupler.
Figure 12:
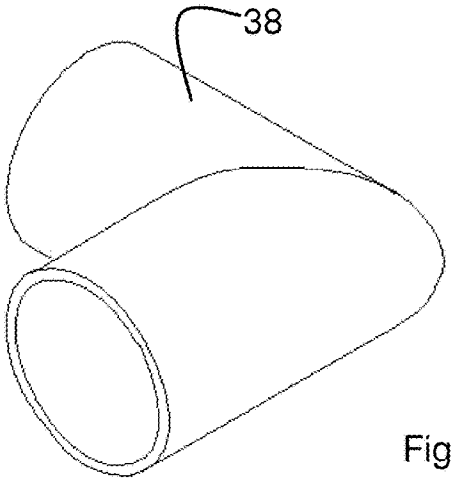
FIG. 12 is a perspective view of a 90° bend.
Figure 13:
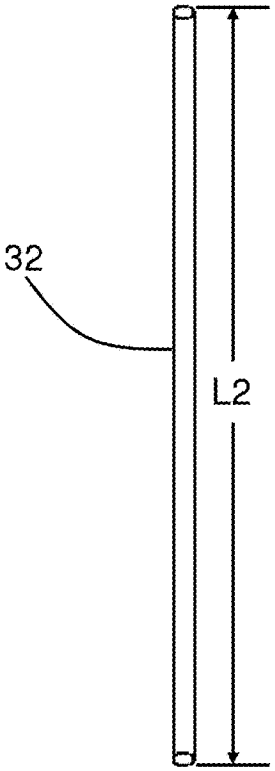
FIG. 13 is a perspective view of a vertical column section having a length L2.

As shown in FIGS. 2 and 3, the system 10 includes a starter section 34 that is in fluid communication with the vertical column sections 32. The system 10 further includes one or more horizontal column sections 36 that are in fluid communication with the starter section 34. The starter section 34 and the horizontal column sections 36 are in fluid communication with one or more bends 38. In an embodiment, the bends 38 are system specific. For example, the bends 38 can have configurations of about 30° (FIG. 11) or about 90° (FIG. 12). As shown in FIG. 2, the sections 34 and 36 and the bends 38 are arranged in a generally circular configuration and positioned at or near the top 20 of the grain dryer 12 adjacent to the column 24. Each of the sections 34 and 36 includes an outlet 40. In an embodiment, the sections 32, 34 and 36 are flanged. As shown in FIGS. 2-8, the sections 32, 34 and 36 and the bends 38 are coupled by one or more groove couplers 42.

Figure 14:
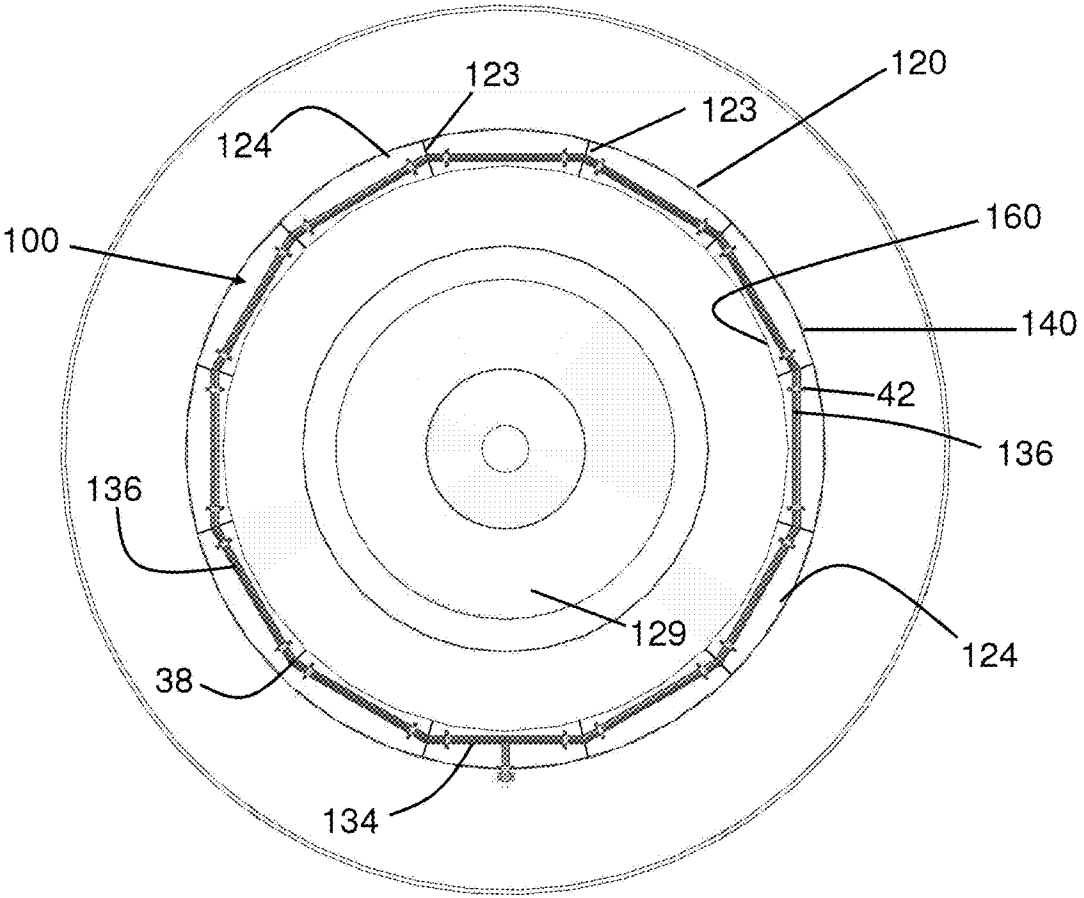
FIG. 14 is a top plan view of a second embodiment column deluge suppression system positioned in a grain dryer.
Figure 15:
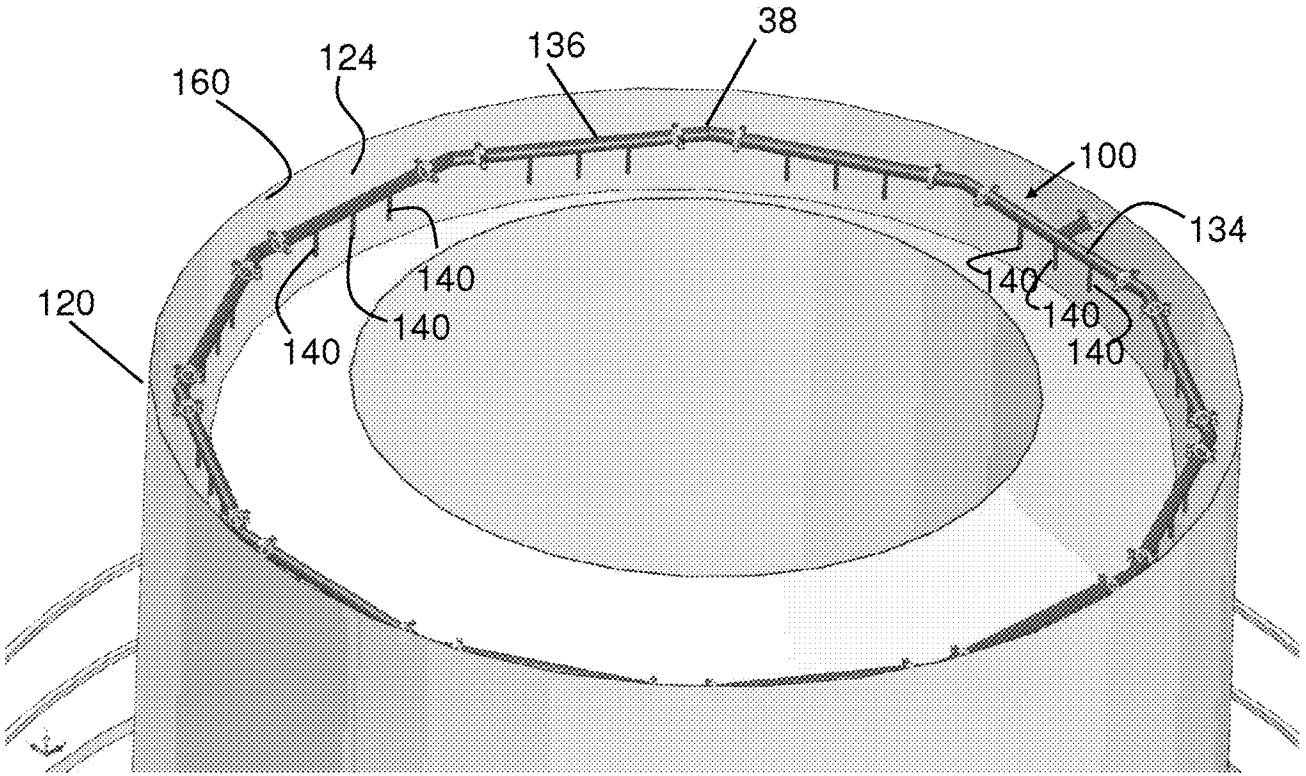
FIG. 15 is a perspective view of the second embodiment column deluge suppression system.
Figure 16:
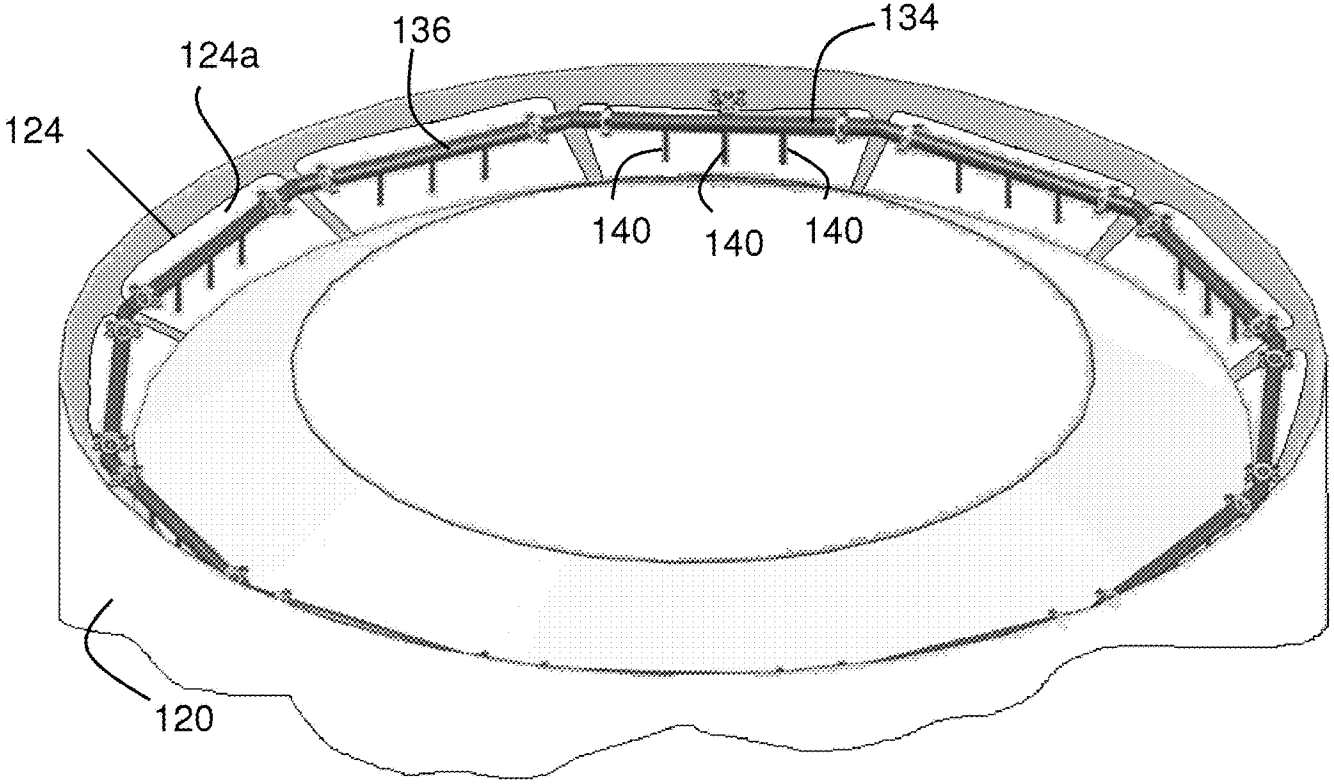
FIG. 16 is a perspective view of the second embodiment column deluge suppression system.
Figure 17:
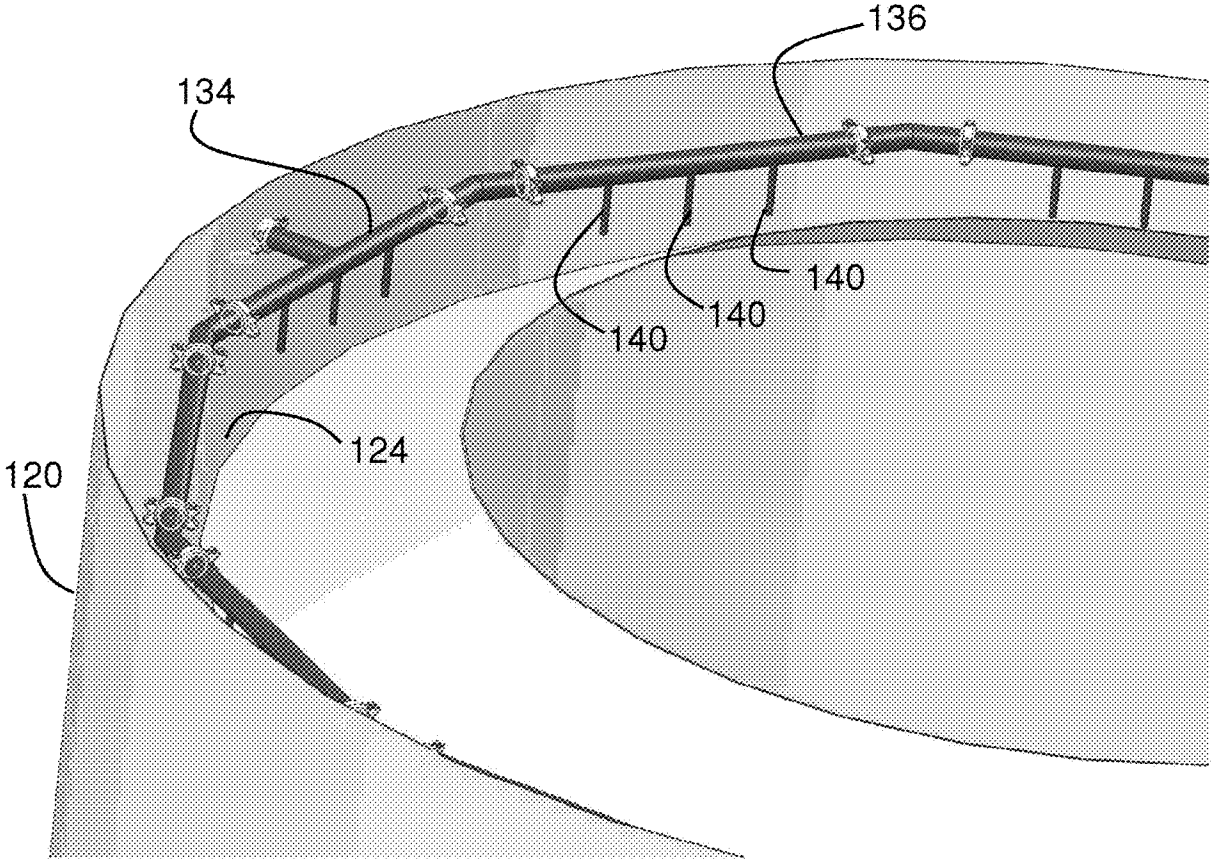
FIG. 17 is a perspective view of the second embodiment column deluge suppression system.
Figure 28:
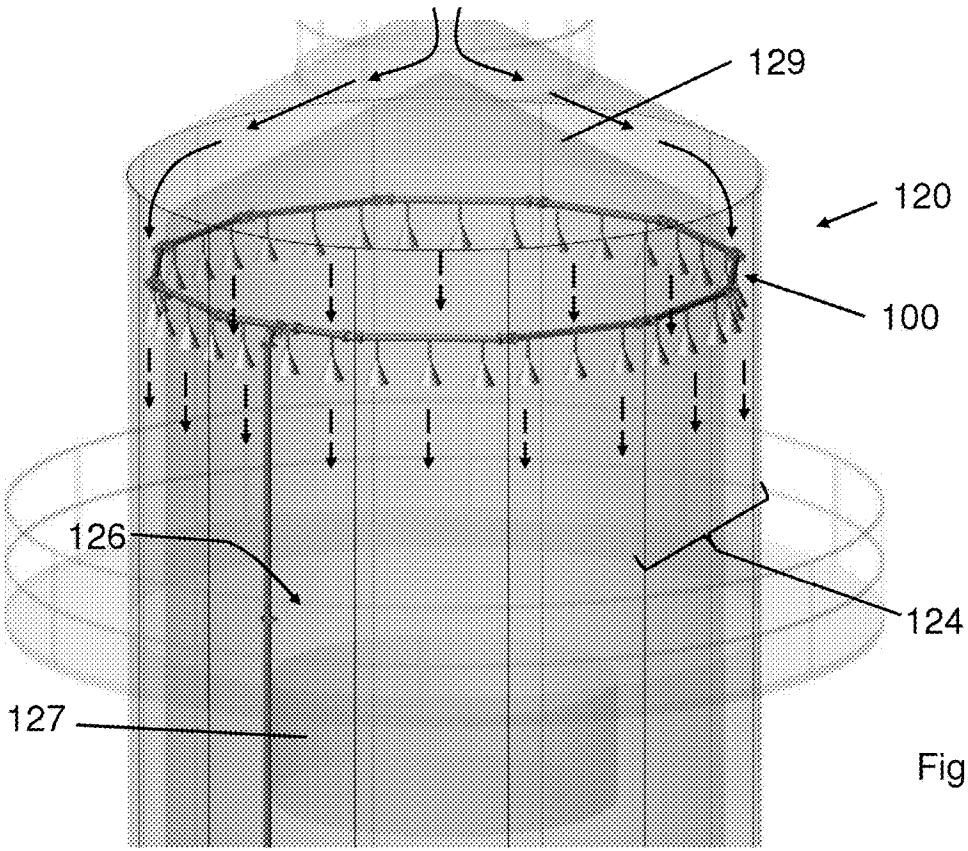
FIG. 28 is a schematic illustration of an embodiment of a column deluge system in a grain dryer.

FIGS. 14-28 illustrate a second embodiment column deluge suppression system, shown generally at 100. As shown in FIG. 14, the column deluge suppression system 100 is mounted onto a grain dryer 120, which is similar to grain dryer 12, described above. The grain dryer 120 includes an exterior 140, configured in one embodiment as a perforated exterior metal skin. An interior 160, also configured in certain embodiments as a perforated interior metal skin, defines inner and outer perimeters of a plurality of grain columns 124. The plurality of grain columns 124 are each defined by separating walls 123. The separating walls 123 may be configured to permit air flow between the column sections 124, though such is not required. The grain columns 124 terminate in openings 124*a* at the upper section of the grain dryer 120. As shown in FIG. 28, the grain dryer 120 includes a heat plenum chamber 126, defining a heated interior space that includes a burner, shown generally at 127, which is conventional in the art. The heat plenum chamber 126 is capped with a top section 129 that deflects the flow of grain (indicated by the solid arrows) into the grain column openings 124*a*. The grain is retained within the grain columns 124 by conventional discharge chute regulators (not shown), which are located at or near the bottom of the chambers 124 and are conventional in the art. The discharge chute regulators selectively permit the grain to be removed from the chambers 124 for normal product delivery or in the event of an emergency.

Figures 20, 21, 22, 23:
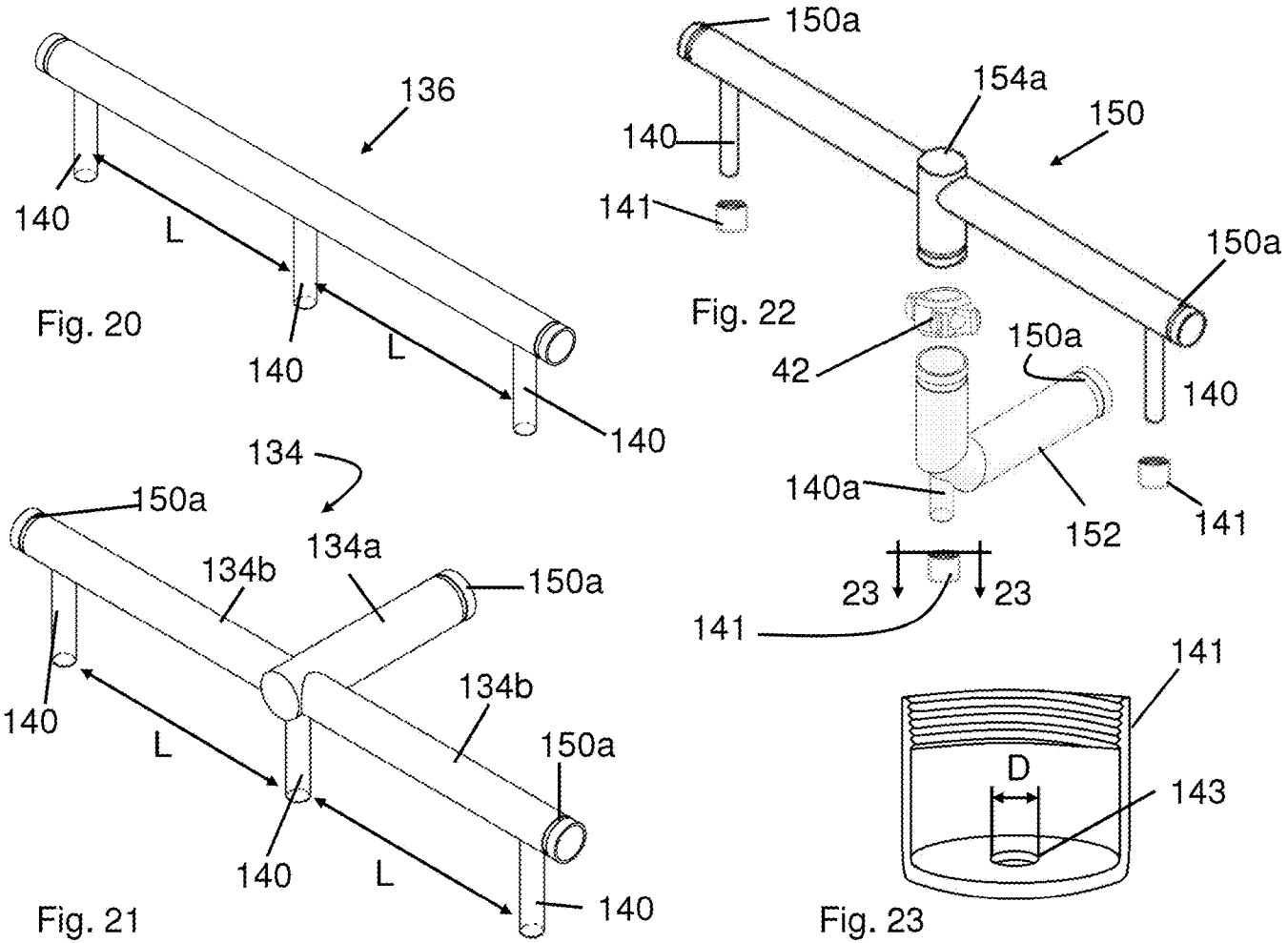
FIG. 20 is a perspective view of an embodiment of a column deluge distribution section.
FIG. 21 is a perspective view of another embodiment of a column deluge distribution section.
FIG. 22 is a perspective view of yet another embodiment of a column deluge distribution section showing an angled supply elbow and column spray nozzles.
FIG. 23 is a cross sectional view of the column spray nozzle of FIG. 22, taken along line 23-23.

The column deluge suppression system 100 is mounted at the top of the grain dryer 120 and configured to be in fluid communication with the grain columns 124. The column deluge suppression system 100 includes one or more vertical supply sections 132, that are similar to the vertical supply section 32, described above. The vertical supply section 132 includes an inlet 130, configured similarly to the inlet 30, described above. The vertical supply section 132 connects to a starter section 134, shown in FIG. 21. The starter section 134 includes an inlet section 134*a* and extending distribution legs 134*b*, that are shown as extending in equal lengths from the inlet section 134*a*; however, such equal length sections are not required. The inlet section 134*a* and distribution legs 134*b* terminate in grooved ends 134*c* that are configured to engage the groove coupler 42, such that a mating section can be connected in fluid communication with the starter section 134. One or more horizontal sections 136, as shown in FIG. 20, are similarly configured with grooved ends 136*a* to mate with elbows and various angled connection elements, such as bends 38, to form an annular, segmented, distribution manifold. The bends 38, of any suitable angle, connect a sufficient number of horizontal sections 136 together, and to the starter section 134, to form the annular manifold, as shown in FIGS. 15-17, and 28.

Extending from the inlet section 134*a* and the distribution legs 134*b* are deluge drops 140. Three deluge drops 140 are shown extending from the starter section 134, though fewer or more may be used if so desired. The deluge drops 140 extend toward the openings 124*a* of the grain columns 124. The deluge drops 140 are elongated such that ingress of grain or dust into the sections is inhibited. The deluge drops 140 are spaced apart by a distance "L" that is sufficient to provide a water spray coverage to the grain columns that they extend towards.

Referring to FIG. 22, there is illustrated another embodiment of a starter section, shown generally at 150. The starter section is a compound starter section 150 that includes a drop inlet 152 and a distribution section 154. The drop inlet 152 and the distribution section 154 include grooved ends 150*a* similar to the grooved ends 134*c*, though such is not required. The distribution section 154 includes a drop connector 154*a* that couples to the drop inlet 152 in order to provide a design-flexible manifold arrangement capable of circumventing obstacles in existing grain dryer structures. The grooved ends 150*a* of the drop inlet 152 and the drop connector 154 are configured to connect together by way of the coupling 42. Though the drop inlet 152 is shown extending upwardly toward the distribution section 154, the drop inlet 152 and drop connector 154*a* may be oriented above the distribution section 154 if desired. The drop inlet 152 includes a deluge drop 140*a*, similar to deluge drop 140. The deluge drop 140*a* extends from the drop inlet 152 and extends a length sufficient to have the ends of the deluge drops generally co-planar. Where the drop inlet 152 is oriented above the distribution section 154, the deluge drop 140*a* may extend from the closed end of the drop connector 154*a*.

The deluge drops 140 and 140*a* include a nozzle 141. The nozzle 141 is formed from a corrosion resistant material, such as stainless steel, bronze, or brass. As shown in FIG. 23, the nozzle 141 includes an orifice 143 having a diameter "D" that is sufficiently large to provide a spray pattern that covers the openings of the grain columns. In one embodiment, the diameter, D is about 5/16 inch and water is delivered to each column at a rate of 17 gallons/minute/column. Thus, where three nozzles 141 are employed, each nozzle will flow about 5.67 gallons per minute. In one embodiment, each nozzle 141 may deliver water in a generally conical spray pattern in a volumetric delivery rate from about 3 gallons per minute to about 7 gallons per minute. The nozzles 141 may be connected to the deluge drops 140 by any suitable structure, such as a threaded connection. In one embodiment, the nozzles 141 are threaded onto the end of the deluge drops 140. In another embodiment, the nozzle 141 may be recessed into the deluge drop 140 by any suitable distance. The horizontal sections 136 include the deluge drops 140 and nozzles 141 in a similar configuration.

Figure 18:
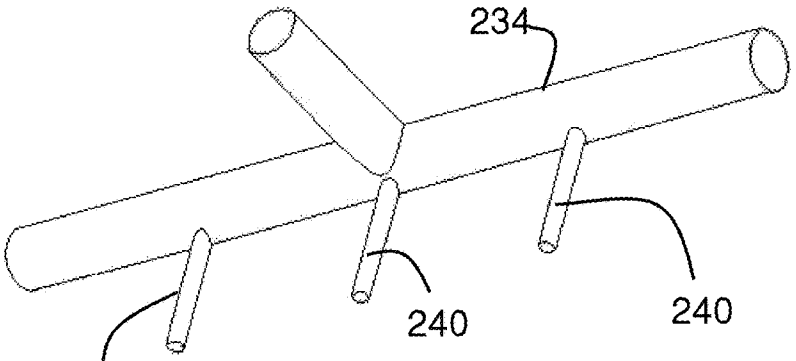
FIG. 18 is a perspective view of a starter section with outlets.
Figure 19:
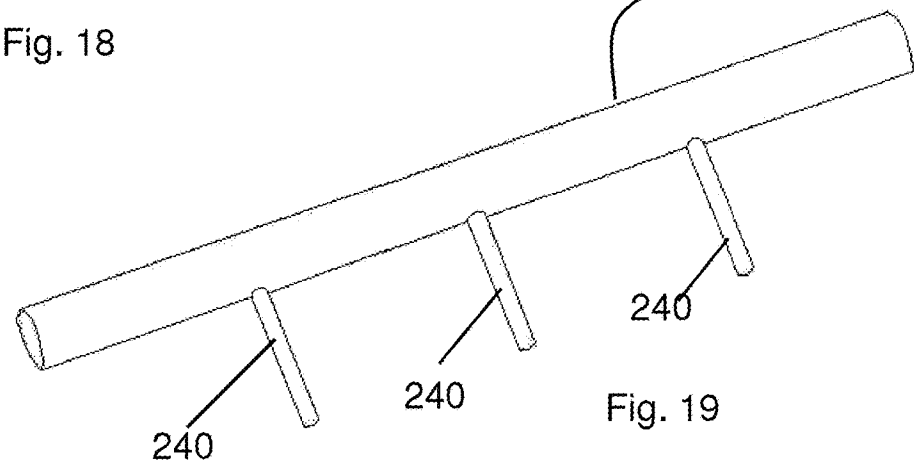
FIG. 19 is a perspective view of a horizontal column section with outlets.

Another embodiment of an inlet section 234 and a horizontal section 236 are shown in FIGS. 18 and 19. The inlet section 234 and the horizontal section 236 are similar to inlet and horizontal sections 134 and 136, described above, and each include deluge drops 240. The inlet and horizontal sections 234 and 236, respectively, include alternative end connections configured as one of a threaded connection, a sweat-fitted connection, and an adhesive joint connection.

In all embodiments, the vertical column sections, the starter section, horizontal column sections, and the bends 38 are sized and adapted to carry a predetermined volume of pressurized water through the system 10 and 100. The water volume, i.e., pressure and flow rate, are determined by the diameter and height of the grain dryer 12 and 120.

Figure 7:
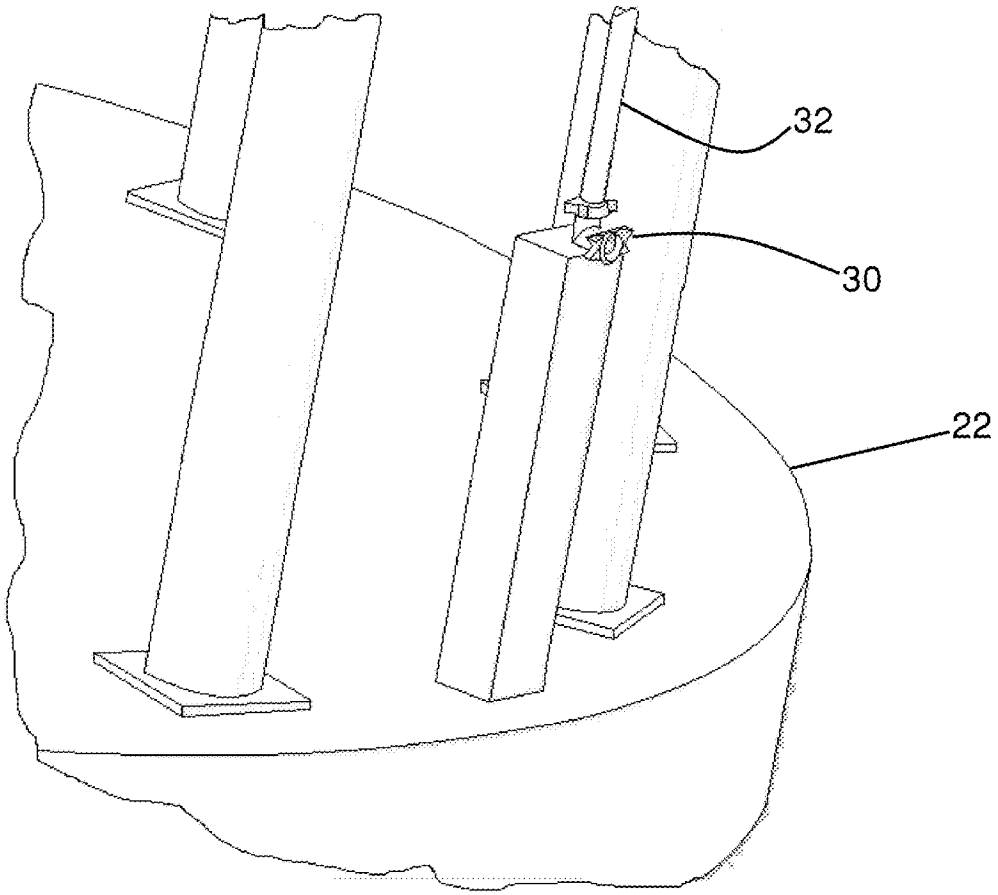
FIG. 7 is a is a detailed view of an inlet positioned on a dryer foundation.
Figure 9:
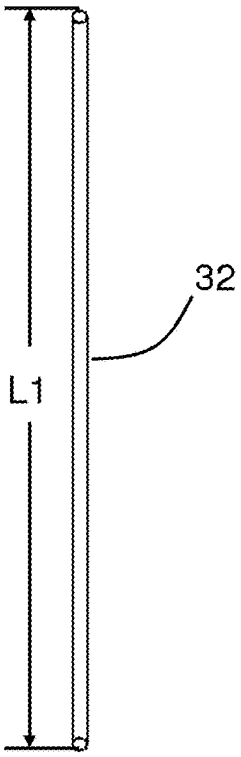
FIG. 9 is a perspective view of a vertical column section having a length L1.
Figure 8:
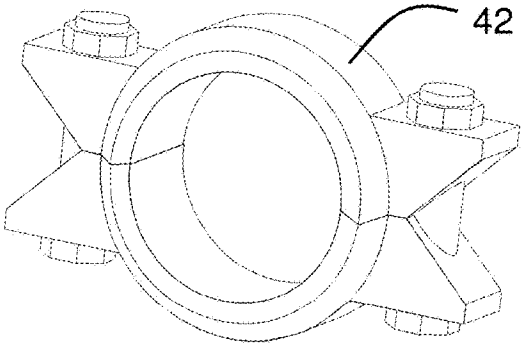
FIG. 8 is a perspective view a groove coupler.
Figure 10:
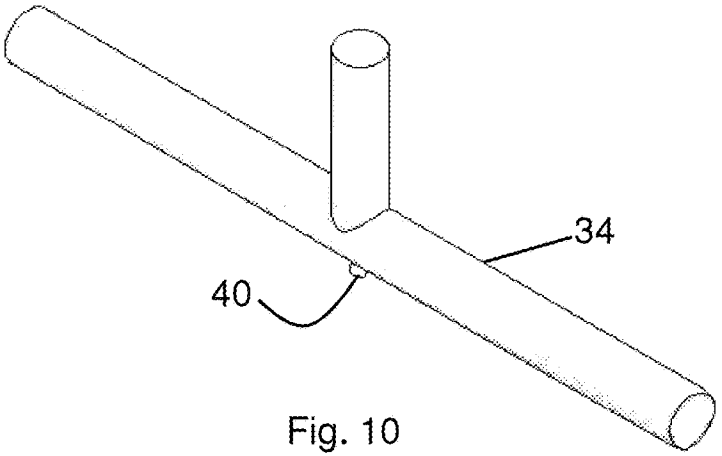
FIG. 10 is a perspective view of a starter section with outlet.
Figure 11:
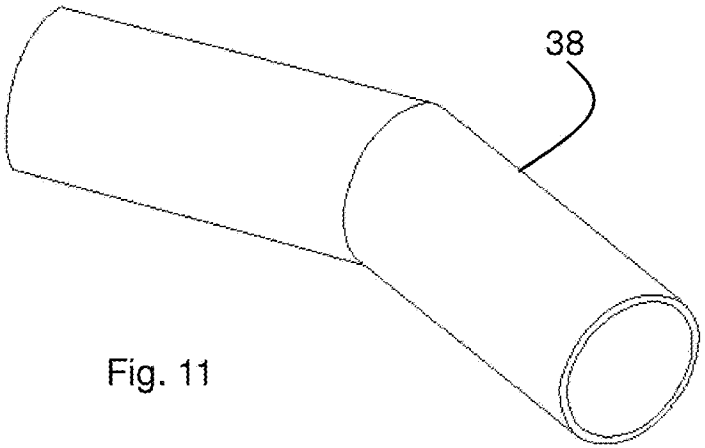
FIG. 11 is a perspective view of a 30° bend.
Figure 24:
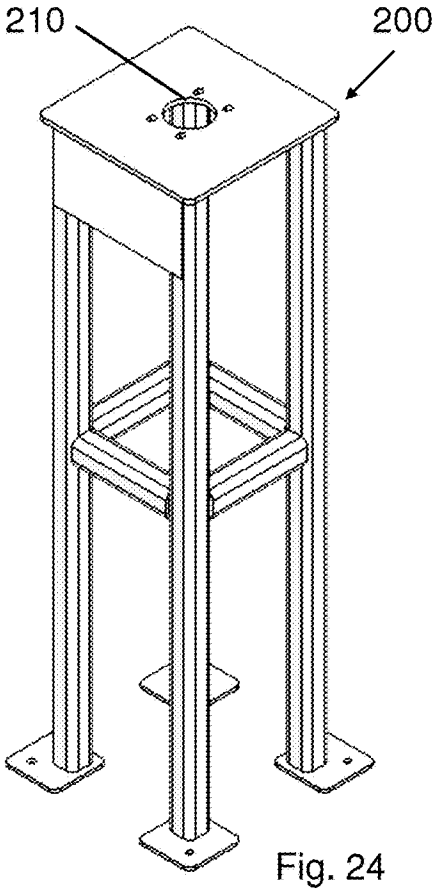
FIG. 24 is a perspective view of an embodiment of a riser stand.
Figure 25:
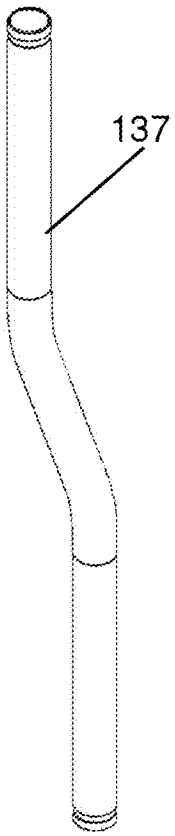
FIG. 25 is a perspective view of an embodiment of an offset supply tube.
Figure 26:
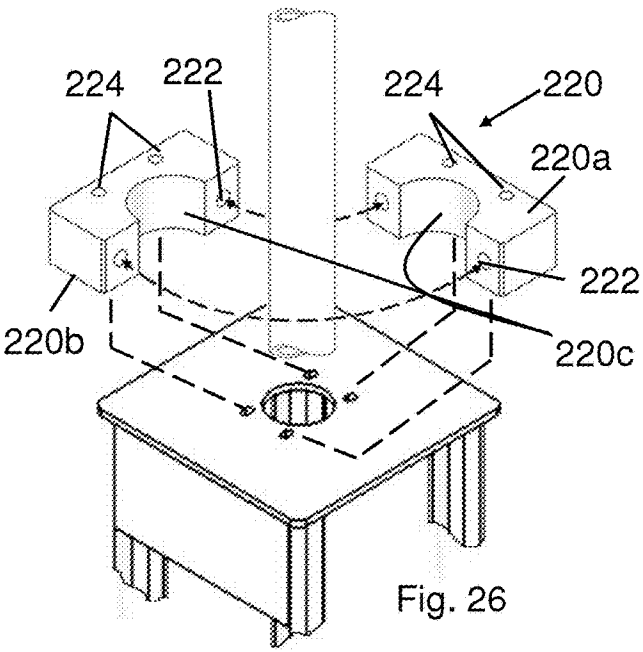
FIG. 26 is an exploded perspective view of an embodiment of a squeeze nut, as part of a riser support assembly.
Figure 27:
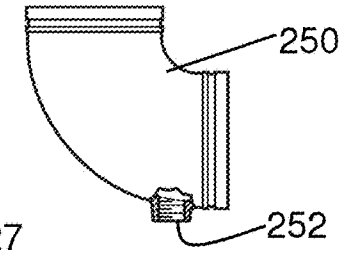
FIG. 27 is an elevational view, in partial cross section, of a drainable connecting elbow for use with the riser support assembly of FIG. 26.

As shown in FIGS. 7 and 24, a riser 200 is provided at the base of the grain dryer 120 to support the weight of the vertical column sections 32 and 132. The riser 200 may include a column aperture 210 that permits a portion of the vertical column sections 32 or 132 to extend therethrough. In one embodiment, an offset column section 137, shown in FIG. 25, may extend through the riser 200 in order to clear obstacles, such as burner fuel feeds, grain discharge chute hatches or grain flow regulators, and the like. The weight of the assembled vertical column sections 32 and 132 are supported by the riser 200, rather than the weight being supported by the grain dryer 12 or 120. The vertical column sections 132 are supported and fixed on the riser 200 by a squeeze nut 220, shown in FIG. 26. In one embodiment, the squeeze nut 220 includes two, substantially identical halves 220*a* and 220*b* that together define an aperture 220*c* that is configured to encircle a pipe section of the vertical column section 132. As shown in FIG. 26, the squeeze nut halves 220*a* and 220*b* include clamping apertures 222 and mounting apertures 224. The clamping apertures 222 (and fasteners—not shown) permit the section to clamp onto the pipe section such that the vertical column section 132 is fixed relative to the squeeze nut 220. The assembled squeeze nut 220 rests on top of the riser 200 and is attached by fasteners (not shown) to corresponding mounting holes on the riser 200. This attachment configuration permits length compensation of vertical column sections 132 relative to the foundation of the grain dryer 12 or 120. Since the suppression system 10 or 100 may be mounted when the grain dryer is empty, relaxing the clamp fit of the squeeze nut 220 when the dryer is filled with grain after system installation permits compensation of the deflections associated with the weight of grain bearing against and supported by the dryer. Thus, residual stresses that would otherwise be applied to the system can now be relaxed and reduced.

The suppression system 10, 100 is configured to be installed and maintained in an empty state, without water. A draining inlet elbow 250, shown in FIG. 27, connects the inlet 130 (under the top of the riser 200) to the vertical column section 132 that passes through the column aperture 210. The draining inlet elbow 250 includes a threaded drain connection 252 that permits connection of a conventional valve (not shown) to evacuate water in the system 100 from, for example, testing, flushing, or use cycles. The system 100 is intended to be maintained in an empty state and charged with water by emergency responders by way of the FDC inlet.

In use, the column deluge suppression system 100 delivers a predetermined volume of pressurized water is delivered to the inlet 30 by a hose or other conduit (not shown), typically supplied by attending emergency responders. The volumetric capacity of the system 10 or 100 is sized to provide sufficient flow to the grain columns to wet the grain contained inside. Additionally, the water is directed by the nozzles 141 to flow in a generally conical pattern, as shown in FIG. 28. Such a spray pattern both drenches the grain and further directs water to cascade down the inner and outer walls of the dryer. The cascading water tends to draw heat and thermal energy away from the grain and toward the walls. This permits a fire or other hazard to be contained and prevented from escalating to other sections. The water travels though the vertical column sections 132 to the starter section 134 and the horizontal column sections 136. Water is discharged through the drops 140 into the grain columns 124. As it will be appreciated, the system 10 and 100 provides high-volume placement of water on demand to suppress a fire in a grain dryer 12 in an efficient, economical, and expeditious manner.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. A column deluge suppression system for a grain dryer, the system comprising:

an inlet in fluid communication with a drainage elbow;

at least one vertical column section in fluid communication with the drainage elbow and extending along an exterior of a grain dryer;

a starter section in fluid communication with the at least one vertical column section and extending from the exterior of the grain dryer to the interior of the grain dryer at a location proximate the top of the grain dryer;

a column deluge manifold in fluid communication with the starter section, the column deluge manifold having a plurality of elongated deluge drops that are in fluid communication with a plurality of grain columns in the grain dryer;

wherein the column deluge manifold includes a plurality of horizontal sections assembled together with the starter section such that the column deluge manifold forms an annular, segmented column deluge manifold;

wherein each of the starter section and the plurality of horizontal sections has three deluge drops positioned over each of the plurality of grain columns;

wherein the starter section has a drop inlet elbow; and wherein one of the deluge drops extends from the drop inlet elbow.

2. The column deluge suppression system of claim 1 wherein the drainage elbow includes a valve and wherein the system is maintained in an empty state until used.

3. The column deluge suppression system of claim 1 wherein each nozzle is configured to provide a generally conical water spray pattern.

4. The column deluge suppression system of claim 2 wherein the weight of the at least one vertical column section is supported by a riser having mounting holes and a squeeze nut having mounting apertures; and wherein the squeeze nut is secured to the riser by fasteners extending through the mounting apertures and into the mounting holes.

* * * * *